US006254684B1

(12) United States Patent
Börner et al.

(10) Patent No.: US 6,254,684 B1
(45) Date of Patent: Jul. 3, 2001

(54) POWDER-SPRAYING APPLIANCE

(75) Inventors: Günter Börner, Mühlhausen; Hans-Christoph Nienburg, Heidelberg; Josef Wittmann, Hockenheim; Helmut Böhme, Nussloch, all of (DE)

(73) Assignee: ABB Research Ltd., Zurich (CH)

( * ) Notice: Subject to any disclaimer, the term of this patent is extended or adjusted under 35 U.S.C. 154(b) by 0 days.

(21) Appl. No.: 09/327,007

(22) Filed: Jun. 7, 1999

Related U.S. Application Data

(63) Continuation of application No. PCT/EP96/05462, filed on Dec. 6, 1996.

(51) Int. Cl.[7] ..... B05B 5/025

(52) U.S. Cl. ..... 118/629; 239/697; 239/698; 427/475

(58) Field of Search ..... 118/621, 627, 118/629, 626, 634, 638; 239/698, 690, 707, 708, 3, 105, 226, 227; 427/475

(56) References Cited

U.S. PATENT DOCUMENTS 4,228,961 * 10/1980 Itoh ..... 239/698

FOREIGN PATENT DOCUMENTS

0237249 * 6/1993 (EP) .
1313511 * 6/1987 (SU) .

* cited by examiner

*Primary Examiner*—Richard Crispino
*Assistant Examiner*—Yewebdar T. Tadesse
(74) *Attorney, Agent, or Firm*—Herbert L. Lerner; Laurence A. Greenberg; Werner H. Stemer

(57) ABSTRACT

A powder-spraying appliance for electrostatic powder coating of work pieces. In order to achieve particularly good charging of powder particles, the powder-spraying appliance contains a chamber, into which a powder/air mixture is introduced transversely to a spraying direction via a supply conduit. An earth electrode and a plurality of high-voltage electrodes are disposed in the chamber. All of the electrodes are flushed with cleaning air in order to avoid powder deposits on the electrodes.

8 Claims, 3 Drawing Sheets

POWDER-SPRAYING APPLIANCE

Cross-Reference to Related Application:

This application is a continuation of copending International Application No. PCT/EP96/05462, filed Dec. 6, 1996, which designated the United States.

BACKGROUND OF THE INVENTION

1. Field of the Invention

The invention relates to a powder-spraying appliance for electrostatic powder coating having a chamber supplied with an air/powder mixture via a supply conduit. At least one high-voltage electrode and an earth electrode are disposed within the chamber for charging the powder.

German Patent DE 27 22 100 C2 discloses a powder-spraying appliance containing at least one chamber. In the chamber, there are disposed a point-discharge electrode opposite to a flow of material and an obtuse-angled counter-electrode having an opposite polarity to the point-discharge electrode and is located upstream at a distance from the latter. In order to improve the charging of the powder particles, a configuration with a plurality of chambers connected in series is provided. It is proposed, moreover, to configure the chamber so as to result continuously in widenings and narrowings which are intended to ensure that material particles are retarded, at the same time being swirled, and are therefore exposed more intensively to the force field. Finally, it is proposed to arrange, so as to be distributed over the circumference of the at least one chamber, orifices, via which additional air is introduced and which reduce the average density of the mixture of air and powder and improve the charging.

Tests have shown that the measures are not sufficient to bring about a coating of powder on a work piece with adequate efficiency. Since the electrodes come directly into contact with the powder, powder is deposited on the electrodes, thus resulting in markedly poorer charging.

It is pointed out, in U.S. Pat. No. 4,811,898, that, in a spraying appliance with a baffle body, the relative position of the baffle body and the electrodes is an essential parameter. Use of external electrodes may be gathered from U.S. Pat. No. 4,228,961.

A powder-spraying appliance is known from Published, European Patent Application EP 0 237 249. The appliance has a chamber, the cross-section of which is larger than the cross-section of a supply conduit for the powder/air mixture. An earth electrode and a plurality of high-voltage electrodes, onto which cleaning air can be blown are disposed in the chamber.

The configuration of the chamber and, in particular, of the electrodes is selected in such a way that a plasma with positive polarity and a plasma with negative polarity are generated. A voltage is applied intermittently to the plasma electrodes. Tests have shown that these measures result in sparking and in the fouling of the electrodes.

SUMMARY OF THE INVENTION

It is accordingly an object of the invention to provide a powder-spraying appliance which overcomes the above-mentioned disadvantages of the prior art devices of this general type, which leads to improved charging of the powder particles and thereby to an improved separation rate.

With the foregoing and other objects in view there is provided, in accordance with the invention, a powder-spraying appliance for electrostatic powder coating, including:

a chamber having a cross-section, a length between 7 and 15 cm, a diameter between 2 to 4 cm, an interior, and a main axis;

an outlet disposed downstream of the chamber;

a plurality of high-voltage electrodes disposed in the chamber for internal charging of a powder of a powder/air mixture, the plurality of high-voltage electrodes annularly distributed in a region upstream of the outlet;

a tubular earth electrode disposed centered in the main axis of the chamber and a spatial distance between the tubular earth electrode and the plurality of high-voltage electrodes is between 7 and 14 cm, the tubular earth electrode has an end directed towards the interior of the chamber and the end has a head part formed with rounded edges closing off the end;

a covering made of an insulating material covers the head part;

a supply conduit for conducting the powder/air mixture and has a cross-section being smaller than the cross-section of the chamber, the supply conduit opening into the chamber transversely to a spraying direction resulting in an intensive swirling of the powder/air mixture; and the tubular earth electrode and the plurality of high-voltage electrodes receiving cleaning air for avoiding powder deposits on the tubular earth electrode and the plurality of high-voltage electrodes.

It was found that, in particular, a powder deposit on the electrodes may be the cause of an unsatisfactory charging of the powder particles. It was also found that the entire chamber should be filled with corona and intensive swirling of the powder particles should take place in the region of the corona, in order to achieve high overall efficiency. These effects are achieved by the features of the invention.

In accordance with a further feature of the invention, one or more outer electrodes provide for an improvement in charging or for field control and, consequently, for increasing the is efficiency.

Another feature relates to a variable arrangement of a distance between the earth electrode and high-voltage electrodes, with the result that an optimum can be established between good charging and disturbing effects, such as reionization.

Other features which are considered as characteristic for the invention are set forth in the appended claims.

Although the invention is illustrated and described herein as embodied in a powder-spraying appliance, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
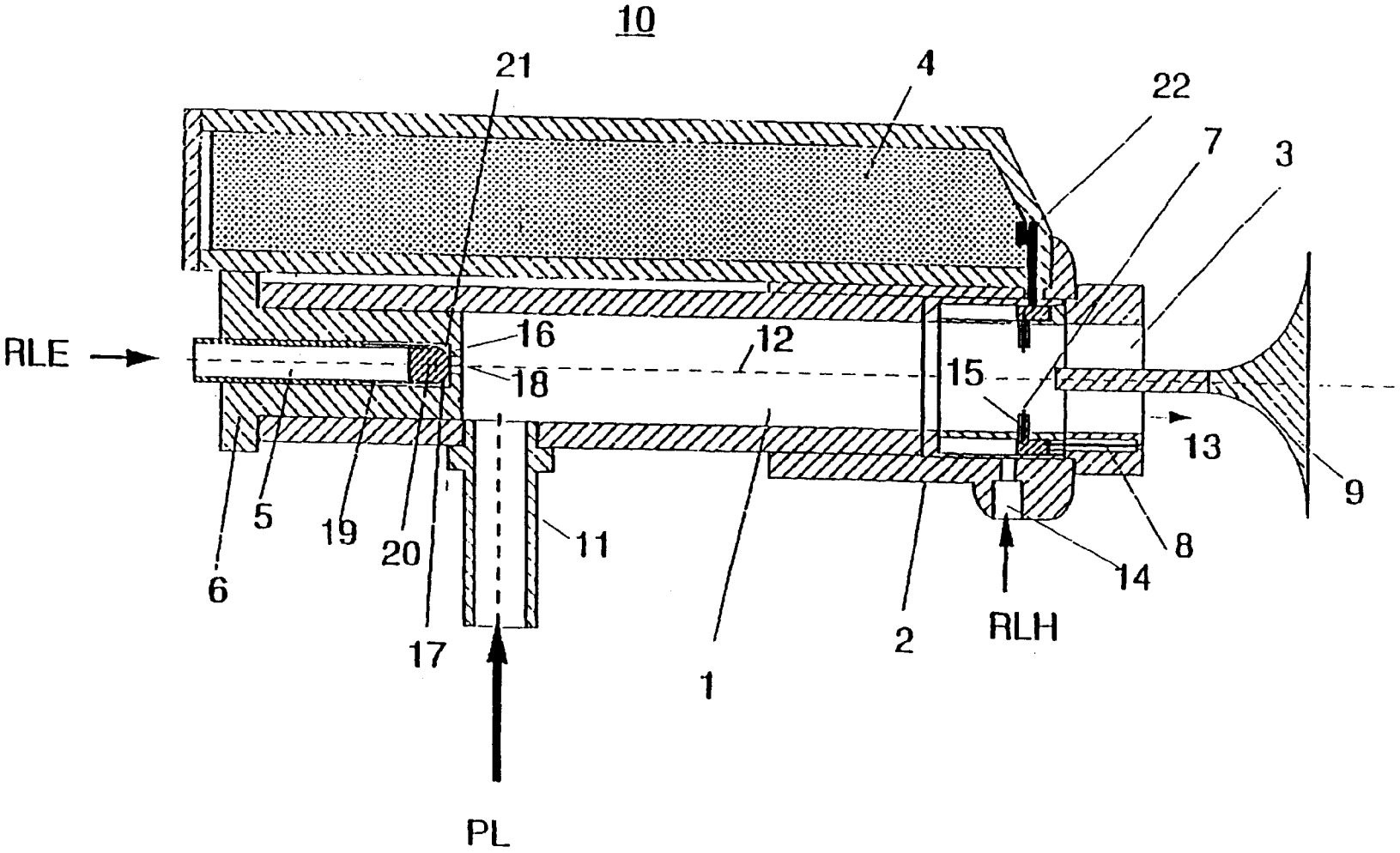
FIG. 1 is a diagrammatic, sectional view of a powder-spraying appliance according to the invention.

In all the figures of the drawing, sub-features and integral parts that correspond to one another bear the same reference symbol in each case. Referring now to the figures of the drawing in detail and first, particularly, to FIG. 1 thereof, there is shown a powder-spraying appliance 10. A swirl chamber 1 is placed onto a carrier element 6 of the powder-spraying appliance 10. The swirl chamber 1 is preferably configured cylindrically in the exemplary embodiment. Instead of a round cross-section, however, an ellipsoidal or polygonal cross-section may also be selected. It is essential that the cross-section of the swirl chamber 1 be larger than a cross-section of a supply conduit 11 for powder and air PL. The powder/air supply conduit 11 opens into the chamber 1 transversely to a main axis 12 of the latter. In principle, the powder/air mixture PL may be introduced in a spraying direction 13, opposite to the spraying direction 13 (FIG. 3) or transversely to the spraying direction 13. The spraying direction 13 is the main axis 12 in a direction of an outlet 3. It has been shown that introducing the powder/air mixture transversely to the main axis 12 brings about a marked improvement in swirling and improved charging. The turbulences occurring in the chamber increase the probability that each powder particle will pass through the region with a high charge density and be charged. The dispersion of the powder particles is improved, at the same time, as a result of the intensive swirling.

The powder is charged by a corona generated at needle-shaped high-voltage electrodes 7 that are at a high-voltage potential. The high voltage is generated with the aid of a high-voltage cascade 4, which is part of the powder-spraying appliance 10, and is delivered to the high-voltage needles via an electrical connection 22.

Figure 2:
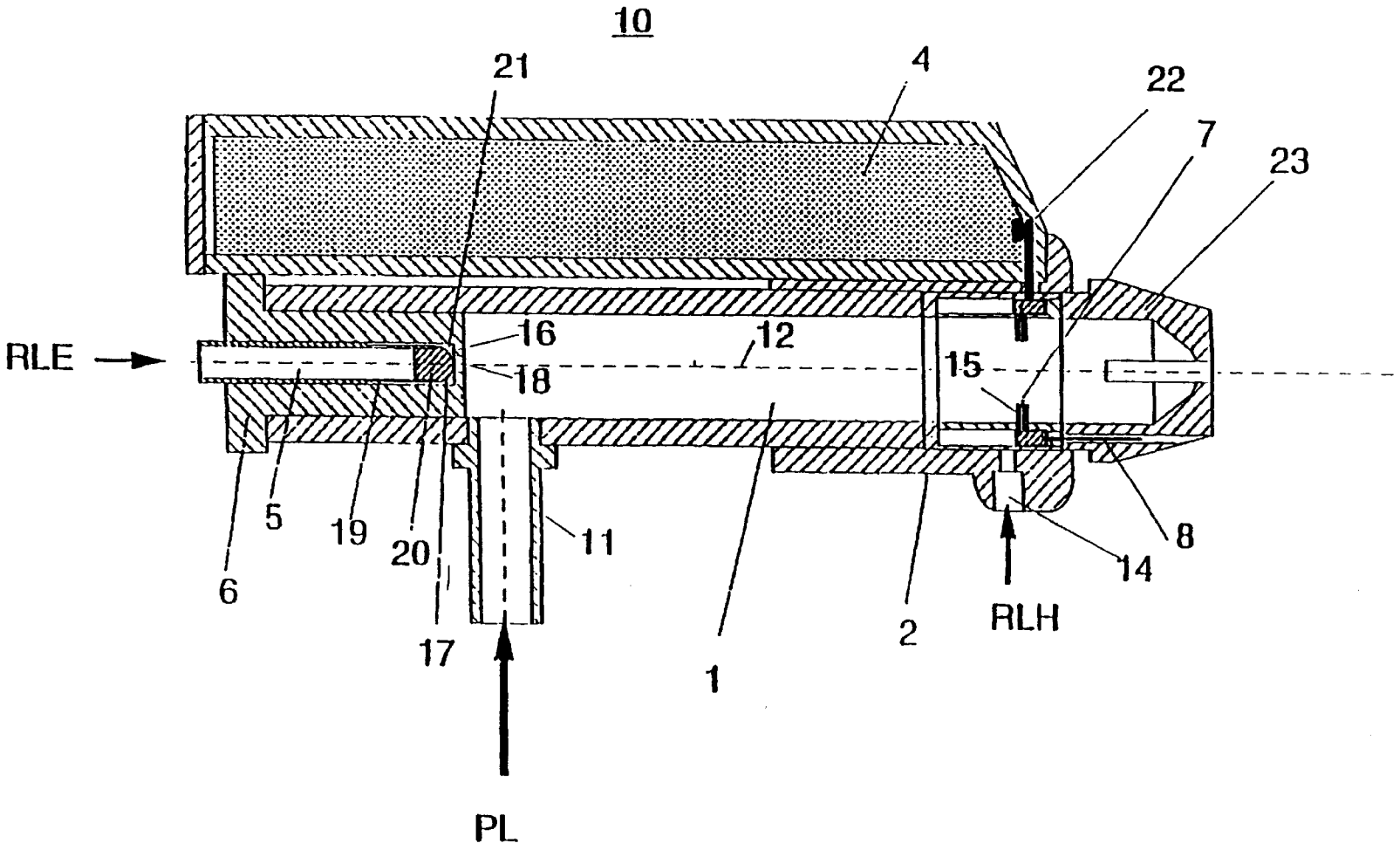
FIG. 2 is a section view of a modified outlet region of the powder-spraying appliance.

The high-voltage electrodes 7 are disposed annularly in a region of an outlet 3 and form an intensive corona in relation to an earth electrode 5. Due to the selected configuration of the high-voltage needles, all the powder particles are forced to move through a zone having high field strength and charge density. If required, the internal charging brought about as a result may additionally be further intensified via external charging by additional electrodes 8 which can be disposed in the region of the outlet 3. An outer baffle body 9 generates a rotationally symmetrical powder cloud of greater or lesser width. A slit-like flat nozzle 23, which generates a flat powder jet, may also take the place of the baffle body 9. Such an alternative configuration of the outlet region is illustrated in FIG. 2. The rest of the powder-spraying appliance is identical to that of FIG. 1 that is described in more detail below.

The needle-shaped high-voltage electrodes 7 are disposed annularly in a front ring 2 so as to be distributed around the circumference. The outlet 3 is placed onto the front ring 2. Four to eight high-voltage electrodes, preferably six electrodes, should be provided.

In a region of the front ring 2 and there, in turn, in the vicinity of the high-voltage electrodes 7, high-voltage electrode cleaning air RLH is introduced transversely to the main axis 12 via an orifice 14. The cleaning air RHL reduces the deposit of powder particles on the electrodes 7. Particularly intensive cleaning of the needle electrodes 7 can be achieved if the electrodes 7 are in each case inserted in small tubes 15 and flushed round with the air RLH there.

The chamber 1 is produced from an insulating material, such as a plastic, a glass or a ceramic. A chamber length of 7 to 15 cm, a diameter of 2 to 4 cm and a distance of 7 to 14 cm between the high-voltage electrodes 7 and an earth electrode are highly suitable. In an advantageous configuration of the spraying appliance 10, the distance between the earth electrode 5 and the high-voltage electrodes 7 can be varied so as to make it possible to set an optimum in terms of charging and reionization.

The earth electrode 5 is of tubular construction and is disposed in the carrier element 6 so as to be centered in the direction of the main axis 12. The tubular earth electrode 5 preferably has an inside diameter of 0.3 cm and an outside diameter of 0.5 cm. At that end of the earth electrode 5 that is directed towards the chamber interior, the earth electrode 5 is closed off by ahead part 20 provided with rounded edges 17. The earth electrode 5 and, in particular, the head part 20 are covered with a covering 16 made of insulating material, in order to avoid electrical breakdowns. The insulating covering 16 has, on the front side, a covering orifice 18 with a diameter of approximately 0.1 to 0.5 cm.

Earth electrode cleaning air RLE is led through the earth electrode 5 and prevents powder particles from settling on the latter. Moreover, the cleaning air RLE ensures that the powder is additionally swirled, and the powder/air ratio can be set or regulated by a change in the air rate.

The tubular earth electrode 5 has, in a region upstream of the head part 20, orifices 19, through which the cleaning air RLE can pass out of the tube into a gap 21 between the earth electrode 5 and the covering 16, flush round the head part 20 and emerge from the covering orifice 18 into the chamber 1.

The cleaning air RLE and RLH supplied for cleaning the earth electrode 5 and the high-voltage electrodes 7 respectively may advantageously be used in order, after the supply of the powder/air mixture PL has been switched off, to blow powder particles out of the chamber 1 and prevent the powder particles from being deposited on the electrodes 5, 7.

Figure 3:
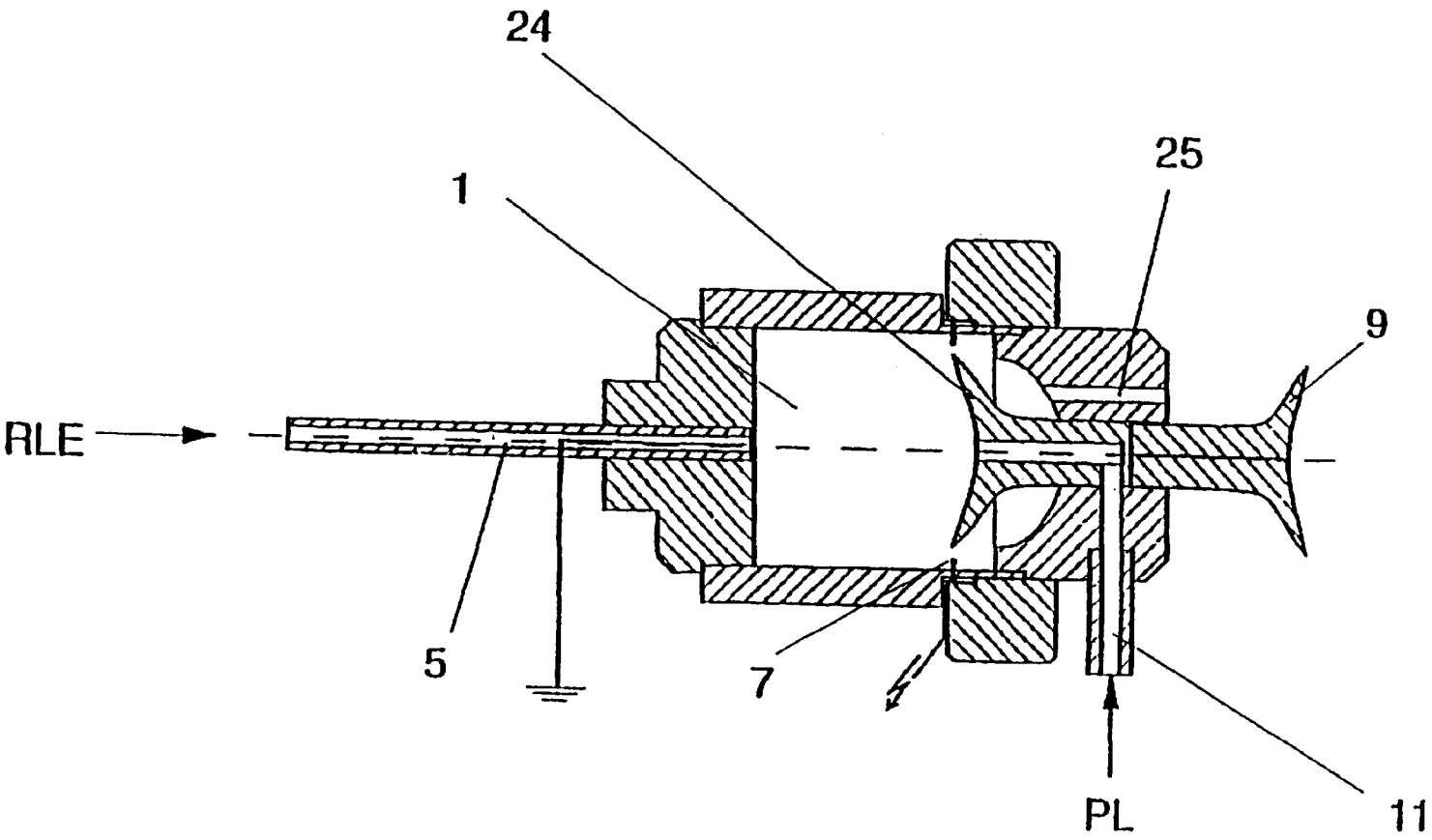
FIG. 3 is a section view of the powder-spraying appliance, with a powder/air mixture being introduced opposite to a spraying direction.

FIG. 3 shows a basic illustration of a powder-spraying appliance in that, as already mentioned further above, the powder/air mixture PL is introduced opposite to the spraying direction via the supply conduit 11. Moreover, FIG. 3 additionally illustrates an inner baffle plate 24 that leads the powder particles nearer to the high-voltage needles 7. The powder then emerges via bores 25 and strikes the outer baffle plate 9. It goes without saying that the other configurations described with reference to FIG. 1 also apply to the configuration according to FIG. 3.

We claim:

1. A powder-spraying appliance for electrostatic powder coating, comprising:

a chamber having a cross-section, a length between 7 and 15 cm, a diameter between 2 to 4 cm, an interior, and a main axis;

an outlet disposed downstream of said chamber;

a plurality of high-voltage electrodes disposed in said chamber for internal charging of a powder of a powder/air mixture, said plurality of high-voltage electrodes annularly distributed in a region upstream of said outlet;

a tubular earth electrode disposed centered in said main axis of said chamber and a spatial distance between said tubular earth electrode and said plurality of high-voltage electrodes being between 7 and 14 cm, said tubular earth electrode having an end directed towards said interior of said chamber and said end having a head part formed with rounded edges closing off said end;

a covering made of an insulating material covering said head part;

a supply conduit for conducting the powder/air mixture and having a cross-section being smaller than said cross-section of said chamber, said supply conduit opening into said chamber transversely to a spraying direction resulting in an intensive swirling of the powder/air mixture; and said tubular earth electrode and said plurality of high-voltage electrodes receiving cleaning air for avoiding powder deposits on said tubular earth electrode and said plurality of high-voltage electrodes.

2. The powder-spraying appliance according to claim 1, wherein said spatial distance between said tubular earth electrode and said plurality of high-voltage electrodes is adjustable.

3. The powder-spraying appliance according to claim 1, including at least one additional electrode disposed in a region of said outlet for ensuring additional external charging and field control.

4. The powder-spraying appliance according to claim 1, including one of a baffle body and a flat nozzle dosed in a region of said outlet.

5. The powder-spraying appliance according to claim 1, wherein said chamber is formed of an insulating material selected from the group consisting of a plastic material, a glass material and a ceramic material.

6. The powder-spraying appliance according to claim 1, wherein said covering has a covering orifice formed therein, said tubular earth electrode has an interior and, in a region located upstream of said head part, orifices are formed in said tubular earth electrode through which the cleaning air can pass out of said interior of said tubular earth electrode into a gap formed between said tubular earth electrode and said covering, flush around said head part and emerge from said covering orifice into said chamber.

7. The powder-spraying appliance according to claim 1, including small tubes disposed in said chamber and receiving and conducting part of the cleaning air, said plurality of high-voltage electrodes are needle-shaped and disposed in each case in said small tubes and cleaned by the cleaning air flowing around the plurality of high-voltage electrodes.

8. A powder-spraying appliance for electrostatic powder coating, comprising:

a chamber having a cross-section, a length between 7 and 15 cm, a diameter between 2 to 4 cm, an interior, and a main axis;

an outlet disposed downstream of said chamber;

a plurality of high-voltage electrodes disposed in said chamber for internal charging of a powder of a powder/air mixture, said plurality of high-voltage electrodes annularly distributed in a region upstream of said outlet;

a tubular earth electrode disposed centered in said main axis of said chamber and a spatial distance between said tubular earth electrode and said plurality of high-voltage electrodes being between 7 and 14 cm, said tubular earth electrode having an end directed towards said interior of said chamber and said end having a head part formed with rounded edges closing off said end;

a covering made of an insulating material covering said head part;

a supply conduit for conducting the powder/air mixture and having a cross-section being smaller than said cross-section of said chamber, said supply conduit opening into said chamber opposite to a spraying direction resulting in an intensive swirling of the powder/air mixture; and said tubular earth electrode and said plurality of high-voltage electrodes receiving cleaning air for avoiding powder deposits on said tubular earth electrode and said plurality of high-voltage electrodes.

* * * * *